US007125218B2

(12) United States Patent
Koyama et al.

(10) Patent No.: US 7,125,218 B2
(45) Date of Patent: Oct. 24, 2006

(54) CIRCUMFERENTIAL FLOW PUMP

(75) Inventors: Masahiro Koyama, Tokyo (JP); Seizo Inoue, Tokyo (JP); Yusaku Sakai, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 72 days.

(21) Appl. No.: 10/893,893

(22) Filed: Jul. 20, 2004

(65) Prior Publication Data

US 2005/0175443 A1 Aug. 11, 2005

(30) Foreign Application Priority Data

Feb. 10, 2004 (JP) ..... P2004-034077

(51) Int. Cl.
*F04D 5/00* (2006.01)
*F01D 1/12* (2006.01)

(52) U.S. Cl. ..... 415/55.1; 415/55.5

(58) Field of Classification Search ..... 415/55.1, 415/55.2, 55.3, 55.4, 55.5, 55.6, 55.7
See application file for complete search history.

(56) References Cited

U.S. PATENT DOCUMENTS

| | | | | |
|---|---|---|---|---|
| 5,328,325 | A | 7/1994 | Strohl et al. | |
| 5,372,475 | A | 12/1994 | Kato et al. | |
| 5,904,468 | A * | 5/1999 | Dobler et al. | 415/55.2 |
| 6,102,653 | A * | 8/2000 | Marx | 415/55.1 |
| 6,481,958 | B1 * | 11/2002 | Wilhelm et al. | 415/55.1 |

* cited by examiner

*Primary Examiner*—Igor Kershteyn
(74) *Attorney, Agent, or Firm*—Sughrue Mion, PLLC

(57) ABSTRACT

Each of impeller grooves of an impeller has a first bow surface that extends from one end surface of the impeller so as to have a radius R1, a second bow surface that extends from the other end surface of the impeller so as to have a radius r1, and a projected partition wall having a connecting surface that connects the first and second bow surfaces. A pump cover and a pump base are provided adjacent to the respective end surfaces of the impeller, and are formed with respective annular feed passages that are defined by semicircular wall surfaces having radii R2 and r2, respectively. The radii R1 and r1 of the first and second bow surfaces are set longer than the radii R2 and r2 of the semicircular wall surfaces, respectively.

3 Claims, 5 Drawing Sheets

CIRCUMFERENTIAL FLOW PUMP

BACKGROUND OF THE INVENTION

1. Field of the Invention

The present invention relates to a circumferential flow pump that is housed in the fuel tank of an automobile, for example, and that supplies fuel to the internal combustion engine at a prescribed pressure.

2. Description of the Related Art

Circumferential flow pumps are known that employ the following measures to increase the pump output power with the same outside dimensions and under the same operation conditions (e.g., Japanese Patent No. 2,962,828). The centers of the radii of annular feed passages are set approximately coincident with the centers of the radii of an impeller, respectively, and the former radii are set equal to the latter radii, respectively. Further, the centers of the above radii are located inside the outline of the impeller. These measures are effective in increasing the C factor of circulating flows (Qc) and thereby increasing the efficiency.

High pump performance is attained by the following measures (e.g., JP-A-6-2690). The impeller is made of a synthetic resin. An impeller plate is formed with a side surface of one impeller groove that communicates with one end surface and an outer circumferential surface of the impeller, a side surface of the other impeller groove that communicates with the other end surface and the outer circumferential surface of the impeller, and a side surface of a communication groove that communicates with the one impeller groove and the other impeller groove in the axial direction on the outer circumference side. The communication groove is located between the one impeller groove and the other impeller groove and is terminated at a position that is inside the outer circumference of the impeller plate. A partition wall is formed so that the interval between the bottom surface of the one impeller groove and the bottom surface of the other impeller groove gradually decreases toward the outer circumference and has a prescribed value or more at the most outer circumference where the bottom surfaces are terminated.

In the above-described conventional circumferential flow pumps, the centers of the radii of the annular feed passages are set approximately coincident with the centers of the radii of the impeller, respectively, and the centers of the radii are located inside the outline of the impeller. In these circumferential flow pumps, as described in JP-A-6-2690, an inactive portion occurs between two symmetrical swirling flows in the impeller grooves. In the inactive portion, liquid fuel is not given a sufficiently high flow velocity and a backward flow occurs. The backward flow prevents fuel pressure increase; even if the C factor of circulating flows (Qc) is increased to produce a high pressure, the internal pressure leakage makes it difficult to increase the fuel pressure. The influence of this pressure leakage is small in the case of an ordinary pump operation. However, for example, when the voltage applied to an electric motor for giving drive force to the circumferential flow pump is low, the pressure leakage is so serious as to make it difficult to obtain a high pressure.

SUMMARY OF THE INVENTION

The present invention has been made to solve the above problems in the art, and an object of the invention is therefore to provide a circumferential flow pump capable of producing a high pressure even in the case where the voltage applied to an electric motor for producing drive force is low.

The invention provides a circumferential flow pump for fuel supply, comprising a pump cover and a pump base that form a pump room; and a disc-shaped impeller designed to rotate in the pump room, the impeller having an annular outer circumferential wall and a plurality of impeller grooves that are partitioned by radial partition walls and arranged in the circumferential direction along the outer circumferential wall and that penetrate through the impeller to form openings in first and second end surfaces of the impeller, wherein the pump cover and the pump base are formed with annular first and second feed passages, respectively, that are symmetrical and are opposed to the impeller grooves, wherein each of the impeller grooves has a first bow surface that extends from an inner circumferential line, in the first end surface, of the impeller groove so as to have a radius R1, a second bow surface that extends from an inner circumferential line, in the second surface, of the impeller groove so as to have a radius r1, and a projected partition wall having a connecting surface that connects the first and second bow surfaces, centers of the radii R1 and r1 being located on the first and second end surfaces, respectively, or on a pump cover side of the first end surface and a pump base side of the second end surface, respectively, the first and second bow surfaces being symmetrical, the projected partition wall and the outer circumferential wall forming a space that penetrates through the impeller to form the openings in the first and second end surfaces, wherein the first feed passage is defined by a first semicircular wall surface that has a radius R2 and forms, in a cover end surface of the pump cover, an inner circumferential line and an outer circumferential line that are opposed to the inner circumferential line and an outer circumferential line, in the first end surface, of each of the impeller grooves, respectively, and the second feed passage is defined by a second semicircular wall surface that has a radius r2 and forms, in a base end surface of the pump base, an inner circumferential line and an outer circumferential line that are opposed to the inner circumferential line and the outer circumferential line in the second end surface, of each of the impeller grooves, respectively, the first and second semicircular wall surfaces being symmetrical, and wherein the radius R1 of the first bow surface is longer than the radius R2 of the first semicircular wall surface and the radius r1 of the second bow surface is longer than the radius r2 of the second semicircular wall surface.

In the invention, the radius R1 of the first bow surface is set longer than the radius R2 of the first semicircular wall surface and the radius r1 of the second bow surface is set longer than the radius r2 of the second semicircular wall surface. Therefore, even when the voltage applied to an electric motor for giving drive force to the circumferential flow pump is low, the size of an inactive portion occurring between two symmetrical swirling flows in each impeller groove is small. Since the pressure increase preventing effect of a backward flow occurring in the inactive portion is lowered, a high pressure can be obtained.

BRIEF DESCRIPTION OF THE DRAWINGS

FIGS. 3 and 3*a* are enlarged vertical sectional views of two alternative configurations of part A of the circumferential flow pump of FIG. 1.

DESCRIPTION OF THE PREFERRED EMBODIMENT

Figure 1:
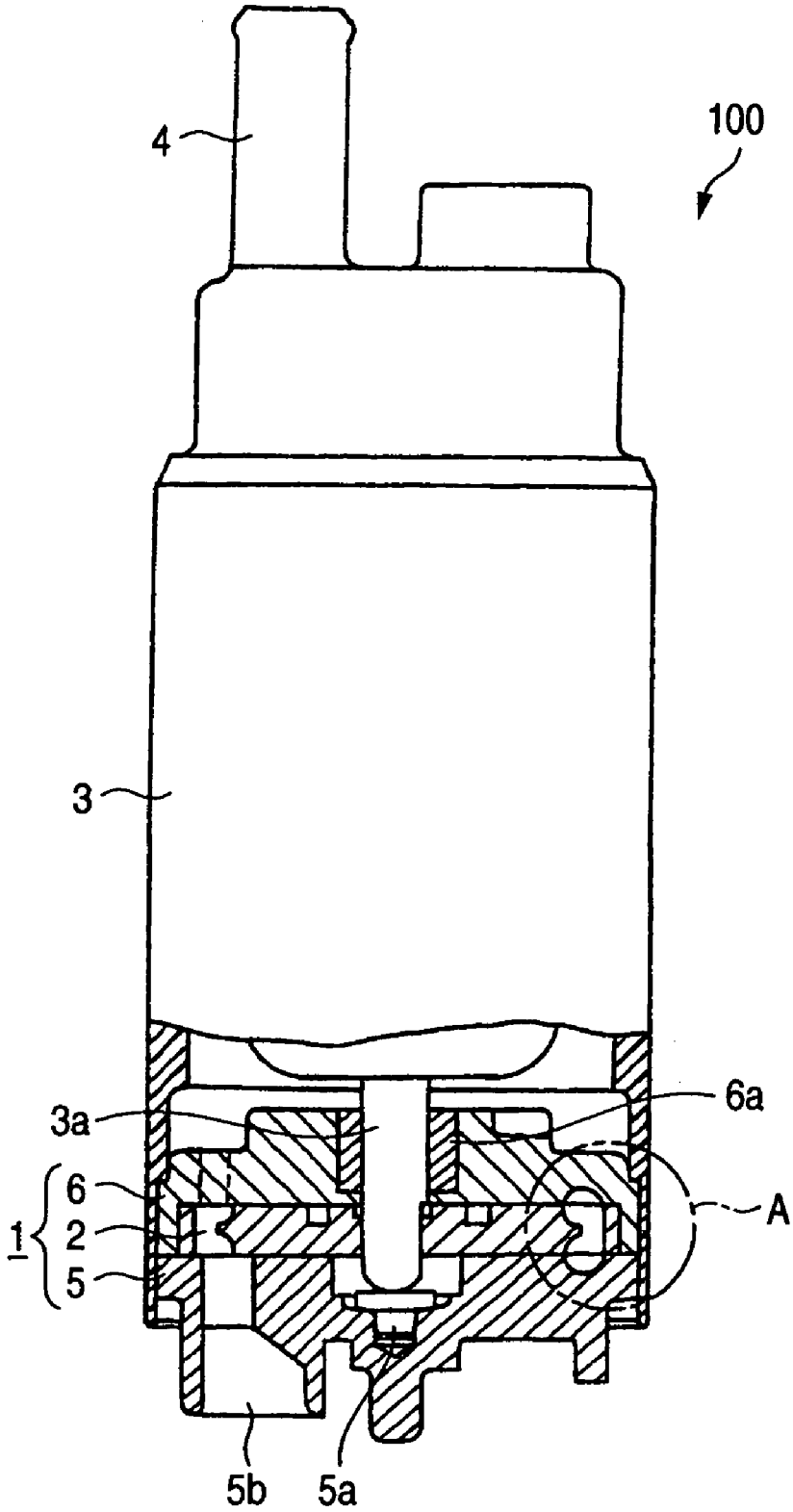
FIG. 1 is a partially cut-away front view of a fuel supply apparatus having a circumferential flow pump according to an embodiment of the present invention.
Figure 2:
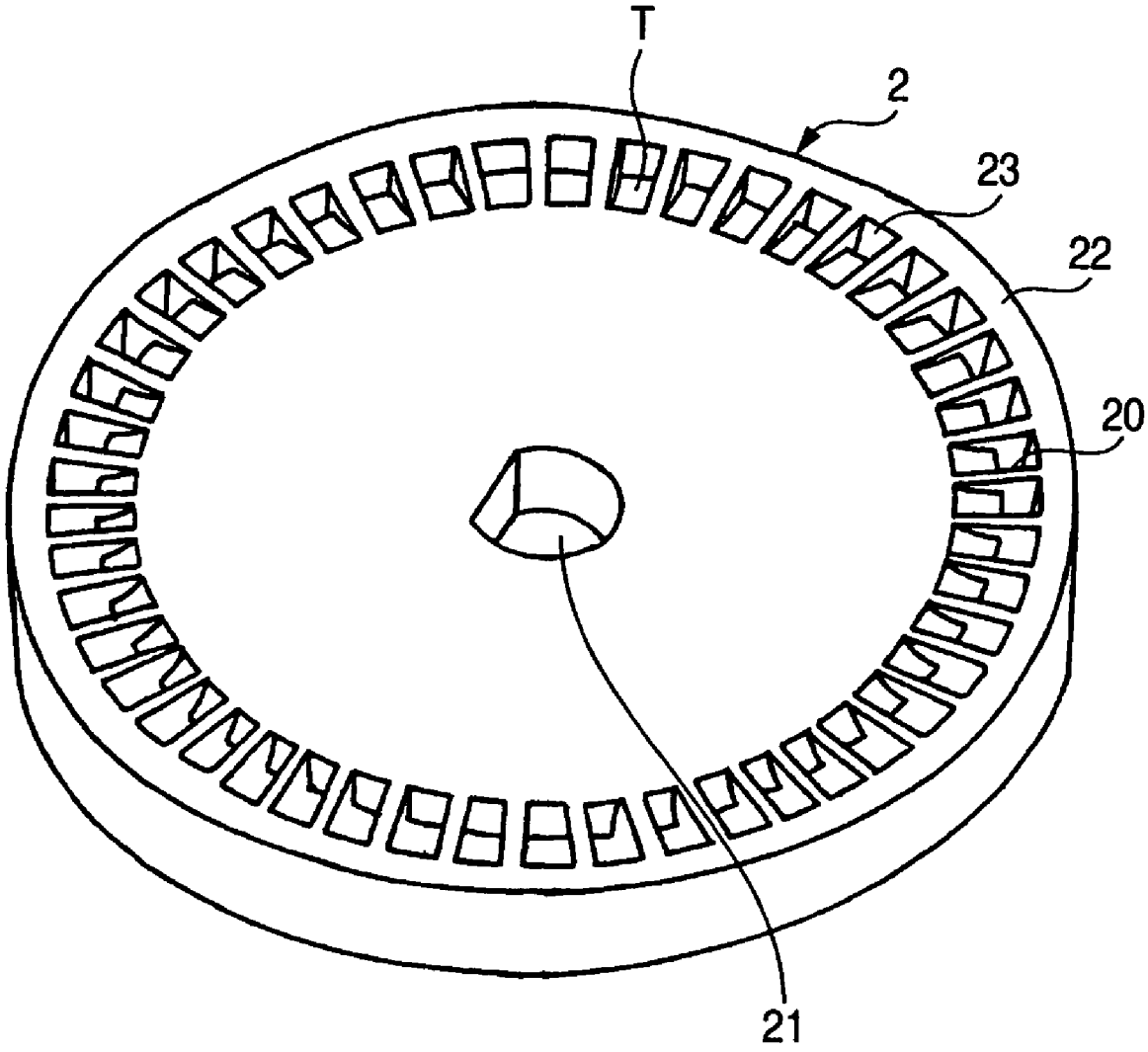
FIG. 2 is an enlarged perspective view showing an appearance of an impeller that is part of the circumferential flow pump of FIG. 1.
Figure 3:
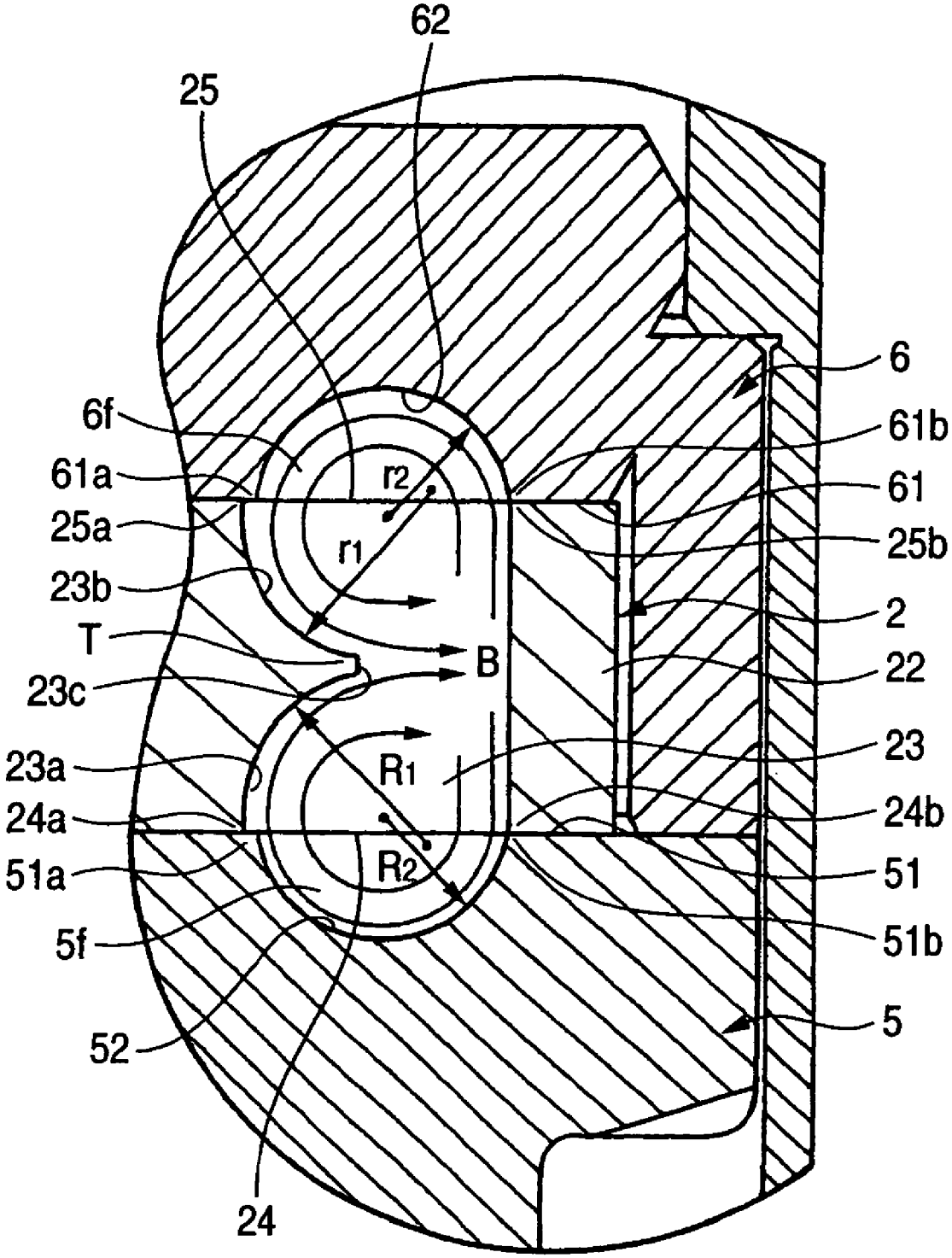
FIG. 3 is an enlarged vertical sectional view of part A of the circumferential flow pump of FIG. 1.
Figure 3A:
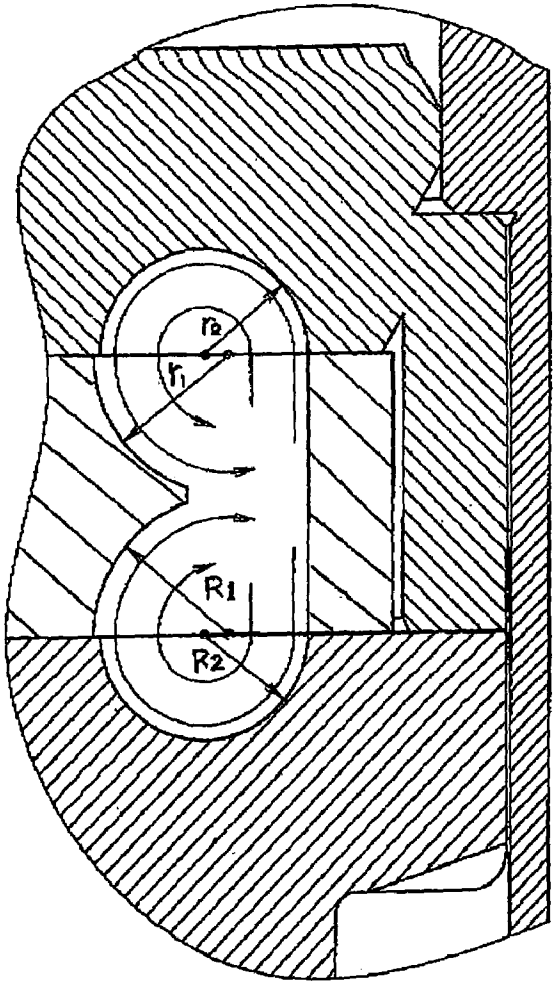
Figure 4:
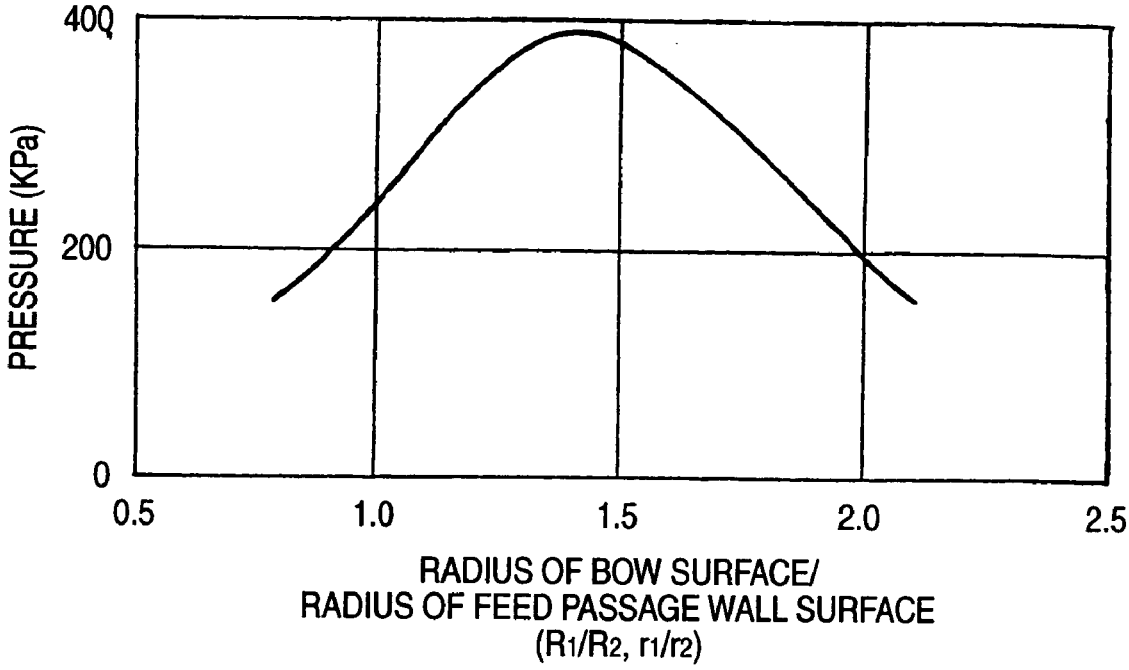
FIG. 4 is a graph showing a relationship between the pressure and the ratio of the radius of the bow surface of each impeller groove to the radius of its feed passage wall surface.

FIG. 1 is a partially cut-away front view of a fuel supply apparatus having a circumferential flow pump according to an embodiment of the present invention. FIG. 2 is an enlarged perspective view showing an appearance of an impeller that is part of the circumferential flow pump of FIG. 1. FIG. 3 is an enlarged vertical sectional view of part A of the circumferential flow pump of FIG. 1. FIG. 4 is a graph showing a relationship between the pressure and the ratio of the radius of a bow surface of each impeller groove of the circumferential flow pump of FIG. 1 to the radius of its feed passage wall surface in a low-voltage condition.

As shown in FIG. 1, a fuel supply apparatus 100 for supplying fuel to, for example, the internal combustion engine of a vehicle is composed of a circumferential flow pump 1, an electric motor 3 for driving the circumferential flow pump 1, and a discharge pipe 4 through which to send, to the internal combustion engine, fuel that is discharged by the circumferential flow pump 1. The circumferential flow pump 1 is composed of an impeller 2 that is joined to a shaft 3*a* of the electric motor 3 and a pump cover 5 and a pump base 6 that house the impeller 2. A thrust bearing 5*a* that supports the shaft 3*a* of the electric motor 3 in the thrust direction is provided at the center of the pump cover 5, and a suction inlet 5*b* through which to introduce fuel (not shown) into the impeller 2 is also provided in the pump cover 5. A metal member 6*a* that supports the shaft 3*a* rotatably is provided at the center of the pump base 6.

As shown in FIGS. 2 and 3, the impeller 2 has a disc shape and is formed with a D-shaped shaft-insertion hole 21 at the center so as to be joined to the shaft 3*a*. The impeller 2 is formed with an annular outer circumferential wall 22, and a plurality of impeller grooves 23 that penetrate through the impeller 2 are partitioned by radial partition walls 20 and arranged in the circumferential direction along the outer circumferential wall 22. Each impeller groove 23 has a generally rectangular outline in both end surfaces of the impeller 2. Strictly, the outline of each impeller groove 23 in each end surface of the impeller 2 assumes arc shapes at the inner and outer ends and has radial sidelines. The impeller 2 is made of a synthetic resin, measures, for example, 33.5 mm in diameter and 3.8 mm in thickness, and has 47 impeller grooves 23. An end surface 51 of the pump cover 5 is formed with a first annular feed passage 5*f* that is opposed to the openings of the impeller grooves 23 in one end surface 24 of the impeller 2. On the other hand, an end surface 61 of the pump base 6 is formed with a second annular feed passage 6*f* that is opposed to the openings of the impeller grooves 23 in the other end surface 25 of the impeller 2. The first and second annular feed passages 5*f* and 6*f* are symmetrical.

In the inside of each impeller groove 23, a first bow surface 23*a* extends from an inner circumferential line 24*a* of the one end surface 24 of the impeller 2 so as to have a radius R1 and a second bow surface 23*b* extends from an inner circumferential line 25*a* of the other end surface 25 so as to have a radius r1. The first and second bow surfaces 23*a* and 23*b* are symmetrical. The first and second bow surfaces 23*a* and 23*b* are connected to each other by a connecting surface 23*c* that is located at the center in the axial direction (top-bottom direction in FIG. 3) of the impeller 2, whereby a projected partition wall T is formed inside each impeller groove 23. The space between the projected partition wall T and the outer circumferential wall 22 penetrates through the impeller 2 and forms the openings in the end faces 25 and 26.

The first annular feed passage 5*f* is defined by a substantially semicircular wall surface 52 that has a radius R2 and forms, in the cover end surface 51 of the pump cover 5, an inner circumferential line 51*a* and an outer circumferential line 51*b* that are opposed to the inner circumferential line 24*a* and an outer circumferential line 24*b* of each impeller groove 23, respectively.

The second annular feed passage 6*f* is defined by a substantially semicircular wall surface 62 that has a radius r2 and forms, in the base end surface 61 of the pump base 6, an inner circumferential line 61*a* and an outer circumferential line 61*b* that are opposed to the inner circumferential line 25*a* and an outer circumferential line 25*b* of each impeller groove 23, respectively. That is, the semicircular wall surface 52 and 62 are symmetrical.

In the above configuration, the radius R1 of the first bow surface 23*a* is set longer than the radius R2 of the wall surface 52 of the first annular feed passage 5*f*. And the center of the radius R1 is located on the plane of the end surface 24 of the impeller 2 or on the pump cover 5 side of that plane.

The radius r1 of the second bow surface 23*b* is set longer than the radius r2 of the wall surface 62 of the second annular feed passage 6*f*, and the center of the radius r1 is located on the plane of the end surface 25 of the impeller 2 or on the pump base 6 side of that plane.

As for the relationships between the impeller grooves 23 of the impeller 2 and the annular feed passages 5*f* and 6*f*, the intersecting points 51*a* and 51*b* of the surface 52 of the first annular feed passage 5*f* and the cover end surface 51 coincide with the inner circumferential line 24*a* and the outer circumferential line 24*b* of each impeller groove 23, respectively. Likewise, the intersecting points 61*a* and 61*b* of the surface wall 62 of the second annular feed passage 6*f* and the cover end surface 61 coincide with the inner circumferential line 25*a* and the outer circumferential line 25*b* of each impeller groove 23, respectively. As shown in FIG. 3, only the inner intersecting points 51*a* and 61*b* may slightly be deviated outward from the respective inner circumferential lines 24*a* and 25*a*.

The operation of the above-configured circumferential flow pump 1 according to the embodiment of the invention will be described below.

(1) When the fuel supply apparatus 100 is immersed in a fuel tank (not shown), fuel flows into the impeller grooves 23 through the suction inlet 5*b*.

(2) Upon application of power to the electric motor 3, the electric motor 3 and the impeller 2 that is joined to the shaft 3*a* of the electric motor 3 start to rotate.

(3) As the impeller 2 rotates, the impeller grooves 23 that are adjacent to the feed passages 5*f* and 6*f* rotate, whereby two swirling flows (indicated by arrows B in FIG. 3) occur in the fuel in each impeller groove 23.

(4) The kinetic energy of the two swirling flows B increases gradually as the impeller 2 rotates, whereby the pressure of the fuel in each impeller groove 3 increases. The pressure-increased fuel passes through the electric motor 3, is discharged from the discharge pipe 4, and is finally supplied to the internal combustion engine (not shown).

In the above-configured circumferential flow pump 1 according to the embodiment, the radius R1 of the first bow surface 23*a* is set longer than the radius R2 of the wall surface 52 of the first annular feed passage 5*f* and the radius r1 of the second bow surface 23*b* is set longer than the radius r2 of the wall surface 62 of the second annular feed passage 6*f*. Therefore, two swirling flows occurring in each impeller groove 23 merge together smoothly near the connecting surface 23*c* and then independent swirling flows are separated again from the merged flow.

Therefore, the size of an inactive portion occurring in the separating portion is small. The pressure increase preventing effect of a backward flow is lowered and hence a high pressure can be obtained. This is particularly remarkable in the case where the voltage applied to the electric motor 3 is low, that is, the rotation speed of the impeller 2 is made as low as 1,500 to 3,000 rpm (steady-state rotation speed: 4,000 to 5,500 rpm).

The inventors conducted experiments using circumferential flow pumps 1 in which the diameter of the impeller 2 was 25 to 45 mm and the voltage applied to the electric motor 3 which gives drive force to the circumferential flow pumps 1 was 6V. A maximum pressure was obtained when the ratio of the radius R1 (r1) of the bow surface 23*a* (23*b*) of the impeller 2 to the radius R2 (r2) of the wall surface 52 (62) of the feed passage 5*f* (6*f*) is set at about 1.4 times. In circumferential flow pumps 1 for compression-feeding fuel to an internal combustion engine, the practical range of the above ratio was 1.0 to 1.9 times. FIG. 4 shows a pressure characteristic that was obtained by the experiments.

In the embodiment, it is preferable that the radius R1 (r1) be 1:0 to 4 mm and the radius R2 (r2) be 1.0 to 2 mm in the case where the diameter of the impeller 2 is 25 to 45 mm.

The centers of the radii R1 and r1 of the first and second bow surfaces 23*a* and 23*b* are located outside the planes of the end surfaces 24 and 25 of the impeller 2, and the centers of the radii R2 and r2 of the wall surfaces 52 and 62 of the annular feed passages 5*f* and 6*f* are located inside the above planes. This facilitates the formation with dies of the bow surfaces 23*a* and 23*b* and the wall surfaces 52 and 62 and allows fuel to flow smoothly in the vicinities of the portions where the bow surfaces 23*a* and 23*b* face the wall surfaces 24 and 25.

As for the relationships between the impeller grooves 23 of the impeller 2 and the annular feed passages 5*f* and 6*f*, the intersecting points 51*a* and 51*b* of the wall surface 52 of the first annular feed passage 5*f* coincide with or slightly deviated outward from the inner circumferential line 24*a* and the outer circumferential line 24*b* of each impeller groove 23, respectively, and, likewise, the intersecting points 61*a* and 61*b* of the wall surface 62 of the second annular feed passage 6*f* coincide with or slightly deviated outward from the inner circumferential line 25*a* and the outer circumferential line 25*b* of each impeller groove 23, respectively. As a result, even if steps are formed between the above lines, they do not obstruct fuel flow; two swirling flows occurring in each impeller groove 23 flow smoothly and hence can produce a high pressure.

What is claimed is:

1. A circumferential flow pump for fuel supply, comprising:

a pump cover and a pump base that form a pump room; and a disc-shaped impeller designed to rotate in the pump room, the impeller having an annular outer circumferential wall and a plurality of impeller grooves that are partitioned by radial partition walls and arranged in the circumferential direction along the outer circumferential wall and that penetrate through the impeller to form openings in first and second end surfaces of the impeller, wherein:

the pump cover and the pump base are formed with annular first and second feed passages, respectively, that are symmetrical and are opposed to the impeller grooves;

each of the impeller grooves has a first bow surface that extends from an inner circumferential line, in the first end surface, of the impeller groove so as to have a radius R1, a second bow surface that extends from an inner circumferential line, in the second surface, of the impeller groove so as to have a radius r1, and a projected partition wall having a connecting surface that connects the first and second bow surfaces, centers of the radii R1 and r1 being located on the first and second end surfaces, respectively, or on a pump cover side of the first end surface and a pump base side of the second end surface, respectively, the first and second bow surfaces being symmetrical, the projected partition wall and the outer circumferential wall forming a space that penetrates through the impeller to form the openings in the first and second end surfaces;

the first feed passage is defined by a first semicircular wall surface that has a radius R2 and forms, in a cover end surface of the pump cover, an inner circumferential line and an outer circumferential line that are opposed to the inner circumferential line and the outer circumferential line, in the first end surface, of each of the impeller grooves, respectively, and the second feed passage is defined by a second semicircular wall surface that has a radius r2 and forms, in a base end surface of the pump base, an inner circumferential line and an outer circumferential line that are opposed to the inner circumferential line and the outer circumferential line in the second end surface, of each of the impeller grooves, respectively, the first and second semicircular wall surfaces being symmetrical; and the radius R1 of the first bow surface is longer than the radius R2 of the first semicircular wall surface and the radius r1 of the second bow surface is longer than the radius r2 of the second semicircular wall surface.

2. The circumferential flow pump according to claim 1, wherein a ratio R1/R2 and a ratio r1/r2 are in a range such that $1.0<R1/R2\leqq 1.9$ and $1.0<r1/r2\leqq 1.9$.

3. The circumferential flow pump according to claim 1, wherein a center of the radius R2 of the first semicircular wall surface is located on an impeller side of the cover end surface and intersecting points of the first semicircular wall surface and the cover end surface coincide with or slightly deviated outward from the inner circumferential line and the outer circumferential line in the first end surface, of each of the impeller groove, respectively, and wherein a center of the radius r2 of the second semicircular wall surface is located on an impeller side of the base end surface and intersecting lines of the second semicircular wall surface and the base end surface coincide with or slightly deviated outward from the inner circumferential line and the outer circumferential line in the second end surface, of each of the impeller groove, respectively.

* * * * *